US006371140B1

(12) United States Patent
Atanda

(10) Patent No.: US 6,371,140 B1
(45) Date of Patent: Apr. 16, 2002

(54) PNEUMATIC UMBRELLA WITH SHELL

(76) Inventor: Dele Atanda, 22 Marquis Parkridgewell Close, Sydenham, London (GB), SE26 5AP ( * ) Notice: Subject to any disclaimer, the term of this patent is extended or adjusted under 35 U.S.C. 154(b) by 0 days.

(21) Appl. No.: 09/560,615

(22) Filed: Apr. 28, 2000

(51) Int. Cl.[7] ..... A45B 19/02

(52) U.S. Cl. ..... 135/20.2; 135/16; 135/22; 135/24; 135/25.4; 135/33.2

(58) Field of Search ..... 135/16, 20.2, 22, 135/25.4, 33.2, 33.4, 33.6, 98, 34.2

(56) References Cited

U.S. PATENT DOCUMENTS 3,863,661 A * 2/1975 Aburto ..... 135/20.2
4,068,675 A * 1/1978 Pappanilolaou ..... 135/20.2
4,523,601 A * 6/1985 Grady ..... 135/22
4,643,210 A * 2/1987 Feld ..... 135/20.2
4,747,422 A * 5/1988 Chung ..... 135/20.2
4,766,920 A * 8/1988 Grady ..... 135/20.2
4,870,983 A * 10/1989 Wang ..... 135/20.2
5,178,174 A * 1/1993 Wu ..... 135/22
5,441,065 A * 8/1995 Lin ..... 135/24
5,725,004 A * 3/1998 Moulder ..... 135/20.2

* cited by examiner

*Primary Examiner*—Beth A. Stephan

(57) ABSTRACT

An umbrella is provided including a lower tube, an upper tube slidably coupled with the lower tube and a slider assembly including a slider slidably mounted along the upper tube. Also included is a retractable assembly mounted on the upper tube and connected to the slider of the slider assembly. The retractable assembly has a raised orientation for deploying the retractable assembly and a lowered orientation for retracting the retractable assembly. Also included is a pneumatic extender connected to the slider of the slider assembly for forcing the same to the raised orientation. When the retractable assembly is retracted, the same forms a protective shell about the tubes.

10 Claims, 6 Drawing Sheets

PNEUMATIC UMBRELLA WITH SHELL

BACKGROUND OF THE INVENTION

1. Field of the Invention

The present invention relates to umbrellas and more particularly pertains to a new pneumatic umbrella with shell for providing an umbrella which is automatically opened and closed and further forms a shell when closed.

2. Description of the Prior Art

The use of umbrellas is known in the prior art. More specifically, umbrellas heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 5,235,997, 4,766,920, 4,747,422; 5,224,505; 2,705,967; 2,503,032; 2,224,882; U.S. Patent Des. 361,198, French No. 347,564, and French No. 2,238,448.

In these respects, the pneumatic umbrella with shell according to the present invention substantially departs from the conventional concepts and designs of the prior art, and in so doing provides an apparatus primarily developed for the purpose of providing an umbrella which is automatically opened and closed and further forms a shell when closed.

SUMMARY OF THE INVENTION

In view of the foregoing disadvantages inherent in the known types of umbrellas now present in the prior art, the present invention provides a new pneumatic umbrella with shell construction wherein the same can be utilized for providing an umbrella which is automatically opened and closed and further forms a shell when closed.

The general purpose of the present invention, which will be described subsequently in greater detail, is to provide a new pneumatic umbrella with shell apparatus and method which has many of the advantages of the umbrellas mentioned heretofore and many novel features that result in a new pneumatic umbrella with shell which is not anticipated, rendered obvious, suggested, or even implied by any of the prior art umbrellas, either alone or in any combination thereof.

To attain this, the present invention generally comprises a lower tube, an upper tube slidably coupled with the lower tube and a slider assembly including a slider slidably mounted along the upper tube. Also included is a retractable assembly mounted on the upper tube and connected to the slider of the slider assembly. The retractable assembly has a raised orientation for deploying the retractable assembly and a lowered orientation for retracting the retractable assembly. Also included is a pneumatic extender connected to the slider of the slider assembly for forcing the same to the raised orientation. When the retractable assembly is retracted, the same forms a protective shell about the tubes.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new pneumatic umbrella with shell apparatus and method which has many of the advantages of the umbrellas mentioned heretofore and many novel features that result in a new pneumatic umbrella with shell which is not anticipated, rendered obvious, suggested, or even implied by any of the prior art umbrellas, either alone or in any combination thereof.

It is another object of the present invention to provide a new pneumatic umbrella with shell which may be easily and efficiently manufactured and marketed.

It is a further object of the present invention to provide a new pneumatic umbrella with shell which is of a durable and reliable construction.

An even further object of the present invention is to provide a new pneumatic umbrella with shell which is susceptible of a low cost of manufacture with regard to both materials and labor, and which accordingly is then susceptible of low prices of sale to the consuming public, thereby making such pneumatic umbrella with shell economically available to the buying public.

Still yet another object of the present invention is to provide a new pneumatic umbrella with shell which provides in the apparatuses and methods of the prior art some of the advantages thereof, while simultaneously overcoming some of the disadvantages normally associated therewith.

Still another object of the present invention is to provide a new pneumatic umbrella with shell for providing an umbrella which is automatically opened and closed and further forms a shell when closed.

Even still another object of the present invention is to provide a new pneumatic umbrella with shell that includes a lower tube, an upper tube slidably coupled with the lower tube and a slider assembly including a slider slidably mounted along the upper tube. Also included is a retractable assembly mounted on the upper tube and connected to the slider of the slider assembly. The retractable assembly has a raised orientation for deploying the retractable assembly and a lowered orientation for retracting the retractable assembly. Also included is a pneumatic extender connected to the slider of the slider assembly for forcing the same to the raised orientation. When the retractable assembly is retracted, the same forms a protective shell about the tubes.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
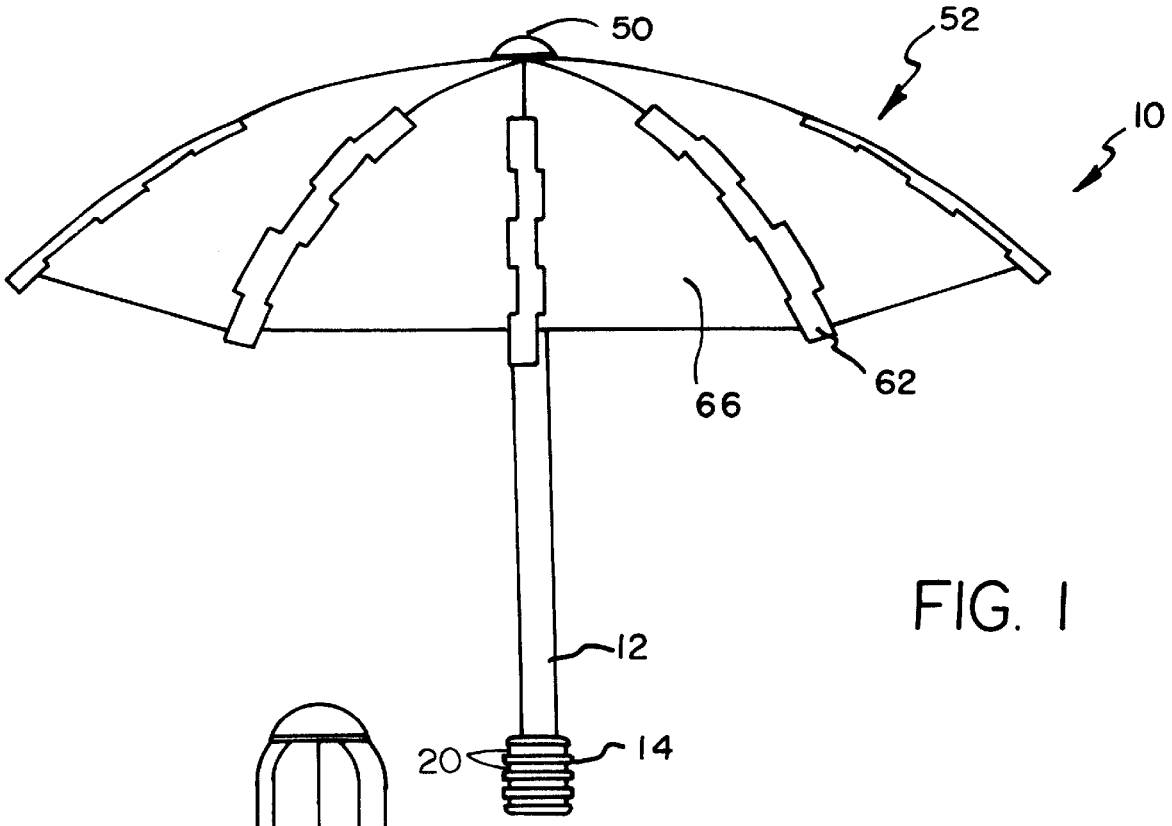
FIG. 1 is a side view of a new pneumatic umbrella with shell according to the present invention.
Figure 2:
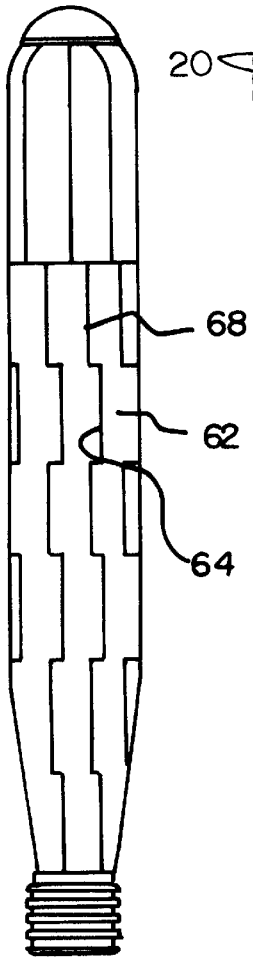
FIG. 2 is a side view of the present invention in a retracted orientation.
Figure 3:
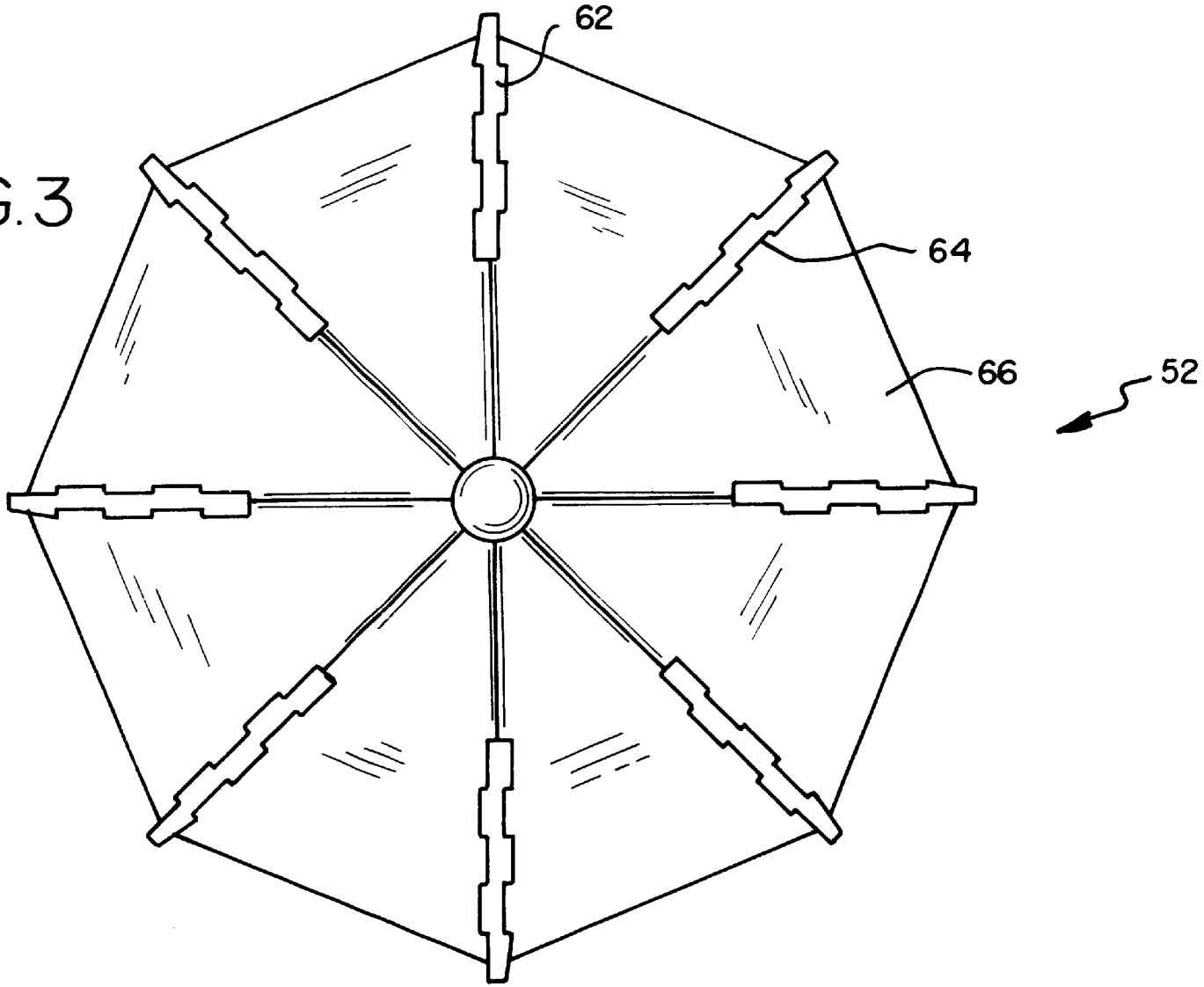
FIG. 3 is a top view of the present invention in a deployed orientation.

With reference now to the drawings, and in particular to FIGS. 1 through 11 thereof, a new pneumatic umbrella with shell embodying the principles and concepts of the present invention and generally designated by the reference numeral 10 will be described.

Figure 10:
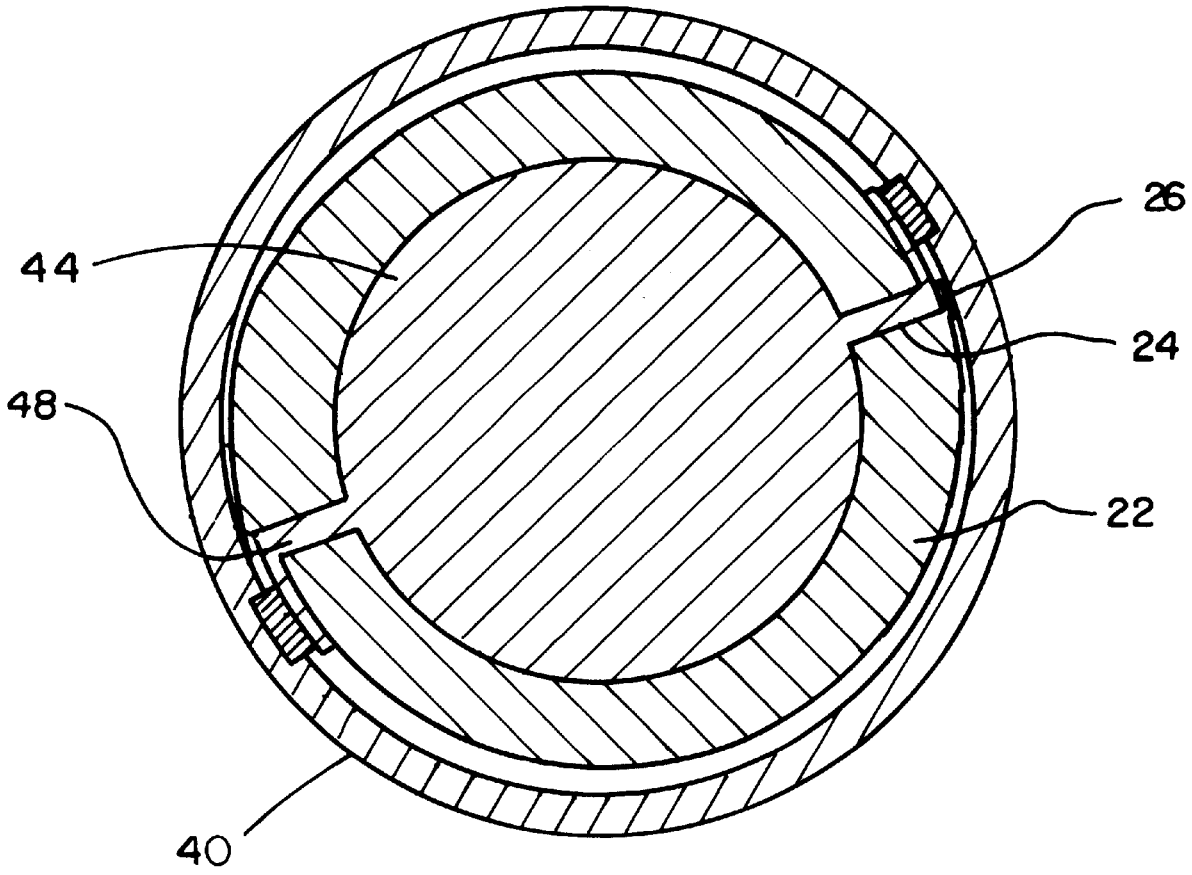
FIG. 10 is a top cross-sectional view of the upper tube and slider assembly of the present invention taken along line 10—10 shown in FIG. 5.
Figure 11:
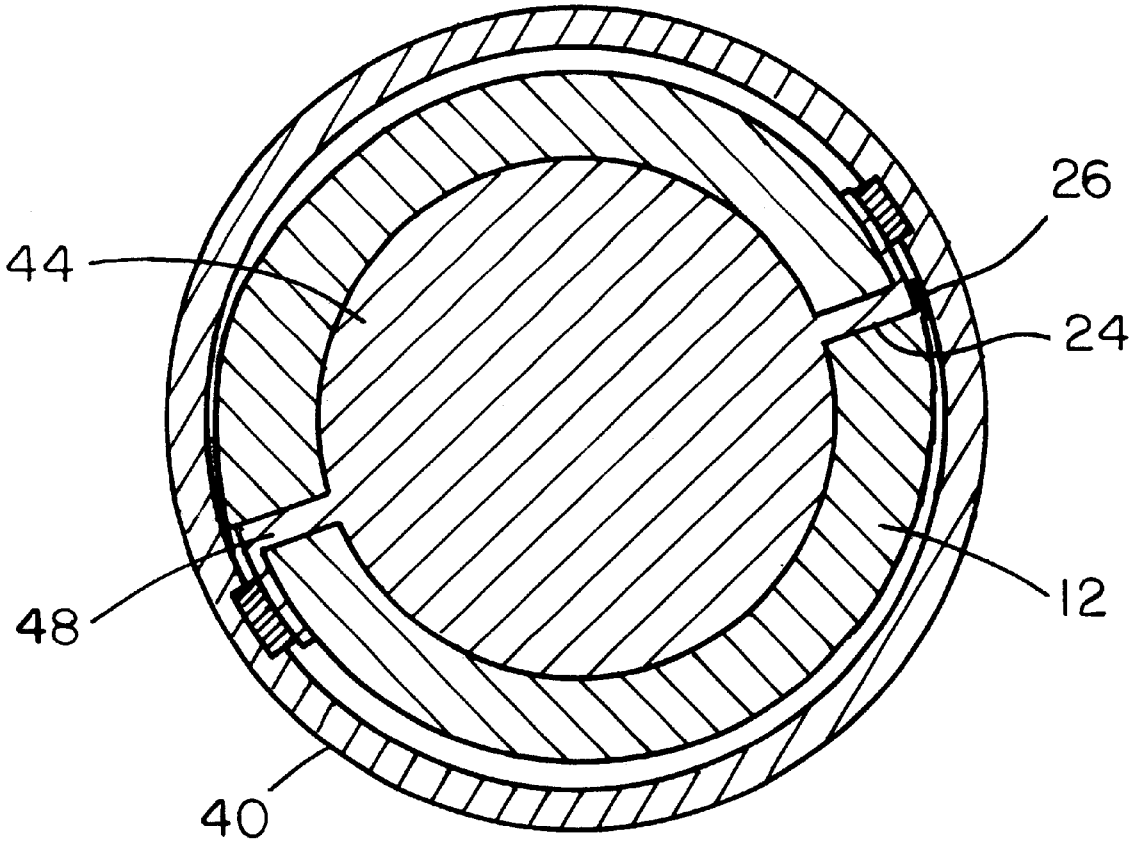
FIG. 11 is a top cross-sectional view of the lower tube and slider assembly of the present invention taken along line 11—11 shown in FIG. 6.

The present invention, designated as numeral 10, includes a lower tube 12 with a hollow cylindrical configuration having a first diameter. A pair of diametrically opposed slits are formed in the lower tube and extend along a length thereof. As shown in FIG. 11 and similar to that shown in FIG. 10, one of the side edges of each of the slits has a resilient lip extending therefrom for covering the associated slit. As such, the lower tube is maintained sufficiently air tight. The lower tube has a bottom end with a hollow cylindrical handle 14 mounted thereon. This handle is equipped with a plurality of concentric undulations formed in an outer surface thereof. Further, a top end of the lower tube has an inwardly extending annular lip 16 formed in an inner surface thereof.

Next provided is an air pressure generator 18 positioned within the handle for reasons that will soon become apparent. The air pressure generator has a push button 20 mounted on the outer surface of the handle. This button serves for excreting air from the handle and into the lower tube upon the depression thereof. To accomplish this purpose, the air pressure generator preferably includes a blower with a motor attached, but may take the form of any type of apparatus for generating pressurized air such as a pressurized carbon dioxide tank or the like.

Associated with the lower tube is an upper tube 22 with a hollow cylindrical configuration. The upper tube has an inner surface with a second diameter less than the first diameter and an outer surface with a third diameter greater than the first diameter. Similar to the lower tube and as shown in FIG. 10, the upper tube has a pair of diametrically opposed slits 24 formed therein with resilient lips 26 which maintain the upper tube air tight. Ideally, the lips 26 abut the opposing half of the tube to afford the foregoing seal.

Figure 5:
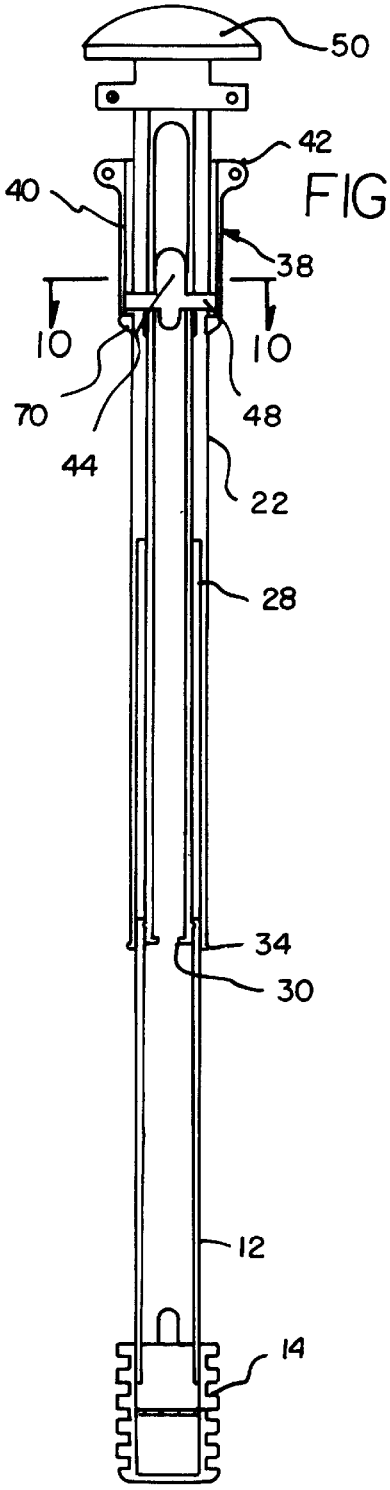
FIG. 5 is a side cross-sectional view of the tubes and slider assembly of the present invention, wherein the slider assembly is in a deployed orientation.
Figure 8:
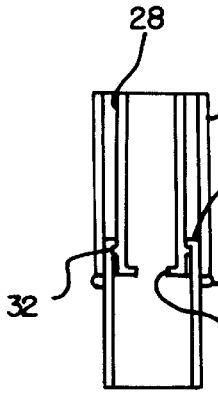
FIG. 8 is a detailed cross-sectional view of the tubes locked with respect to each other in the extended orientation.
Figure 9:
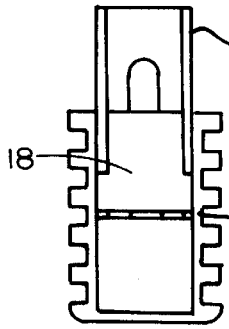
FIG. 9 is a detailed cross-sectional view of the handle and pressurized air generator of the present invention.

The upper tube further has a concentric recess 28 formed between the inner surface and the outer surface of the upper tube. Such concentric recess extends between a central extent of the upper tube and a lower end of the upper tube. As shown in FIGS. 5 & 8, the lower end of the upper tube has an inwardly extending annular flange 30 coupled to the inner surface of the upper tube. An outwardly extending annular flange 32 is mounted within the concentric recess. Note again FIGS. 5 & 8. For reasons that will soon become apparent, an outwardly extending annular stop 34 is formed on the outer surface of the upper tube.

Figure 6:
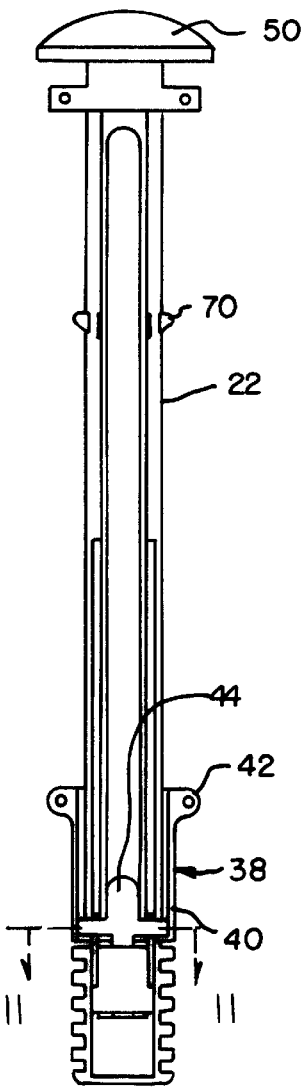
FIG. 6 is a side cross-sectional view of the tubes and slider assembly of the present invention, wherein the slider assembly is in a retracted orientation.
Figure 7:
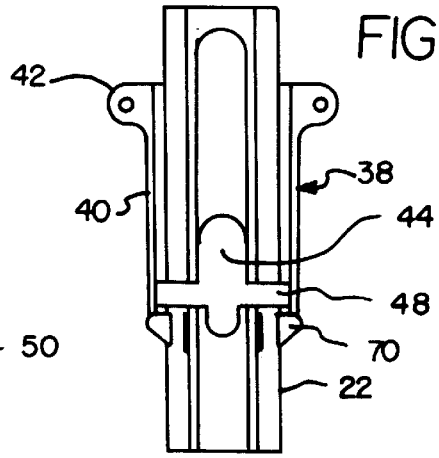
FIG. 7 is a detailed cross-sectional view of the slider assembly locked within the raised orientation by the plungers.

In use, the top end of the lower tube is slidably received within the concentric recess between a retracted orientation shown in FIG. 6 and an extended orientation shown in FIG. 5. In the extended orientation, the outwardly extending annular flange of the upper tube remains in engagement with the inwardly extending annular lip of the lower tube. Further, the slits of the upper tube and the lower tube remain in alignment. This may be accomplished by a slot and groove combination or the like.

Also included is a slider assembly 38 having a hollow cylinder 40 slidably mounted along the outer surface of the upper tube. The cylinder of the slider assembly includes a pair of radially spaced tangs 42 extending outwardly therefrom at an upper edge thereof. Next provided is a piston 44 slidably positioned within the upper tube with a pair of diametrically opposed arms 48 coupled thereto and extending therefrom through the slits of the tubes. Such arms are coupled to an inner surface of the hollow cylinder for moving coincidentally therewith. As the arms pass through the tubes, the aforementioned lips 26 are biased outwardly only slightly to allow minimal loss of air within the tube. Ideally, the arms have an L-shaped cross-section for affording an optimal seal of the associated tube. Note FIG. 10. In use, the plunger is prevented from leaving the upper tube by the inwardly extending flange. Mounted on an upper end of the upper tube is a cap 50. It should be noted that the upper tube may be sealed by any desired means.

FIGS. 1–4 show a canopy assembly 52 including a plurality of radially spaced upper inboard arms 54 hingably coupled at inboard ends thereof to the cap and extending outwardly therefrom. A plurality of lower inboard arms 56 with lengths greater than that of the upper inboard arms are also provided. Such lower inboard arms 56 are pivotally coupled at inboard ends thereof to the tangs of the cylinder of the slider assembly. The lower inboard arms are further pivotally coupled at central extents thereof to outboard ends of the upper inboard arms. As bests shown in FIG. 4, a plurality of intermediate arms 60 have inboard ends pivotally coupled to the upper inboard arms.

The canopy assembly further includes a plurality of uniquely designed metal or plastic outboard arms 62 each pivotally coupled to outboard ends of the intermediate arms and the lower inboard arms. The outboard arms are each constructed from a resilient material and have an outer surface with an arcuate lateral cross-section and an inner surface with a similar arcuate lateral cross-section. A pair of side edges of the outboard arms are corrugated with a plurality of cut outs 64 of any shape.

The canopy assembly further includes flexible elastic sheet 66 mounted on the arms for defining a hemispherical configuration when the cylinder of the slider assembly is in a raised orientation. When the cylinder of the slider assembly is in such orientation, the outboard ends arms of the canopy assembly are biased to form an arcuate configuration. Upon the cylinder of the slider assembly being in a lowered orientation, the side edges of the outboard arms straighten out and interlock to define a cylindrical shell 68 which encompasses the tubes in concentric relationship.

Also included is a pair of diametrically opposed spring biased plungers 70. As shown in FIGS. 4–7, the plungers are mounted within the upper tube between the inner surface and the outer surface thereof. In use, the plungers extend radially outward from the tubes. Ideally, the plungers are spring loaded transducers of electromagnetic solenoids adapted to retract only upon the receipt of an activation signal.

Figure 4:
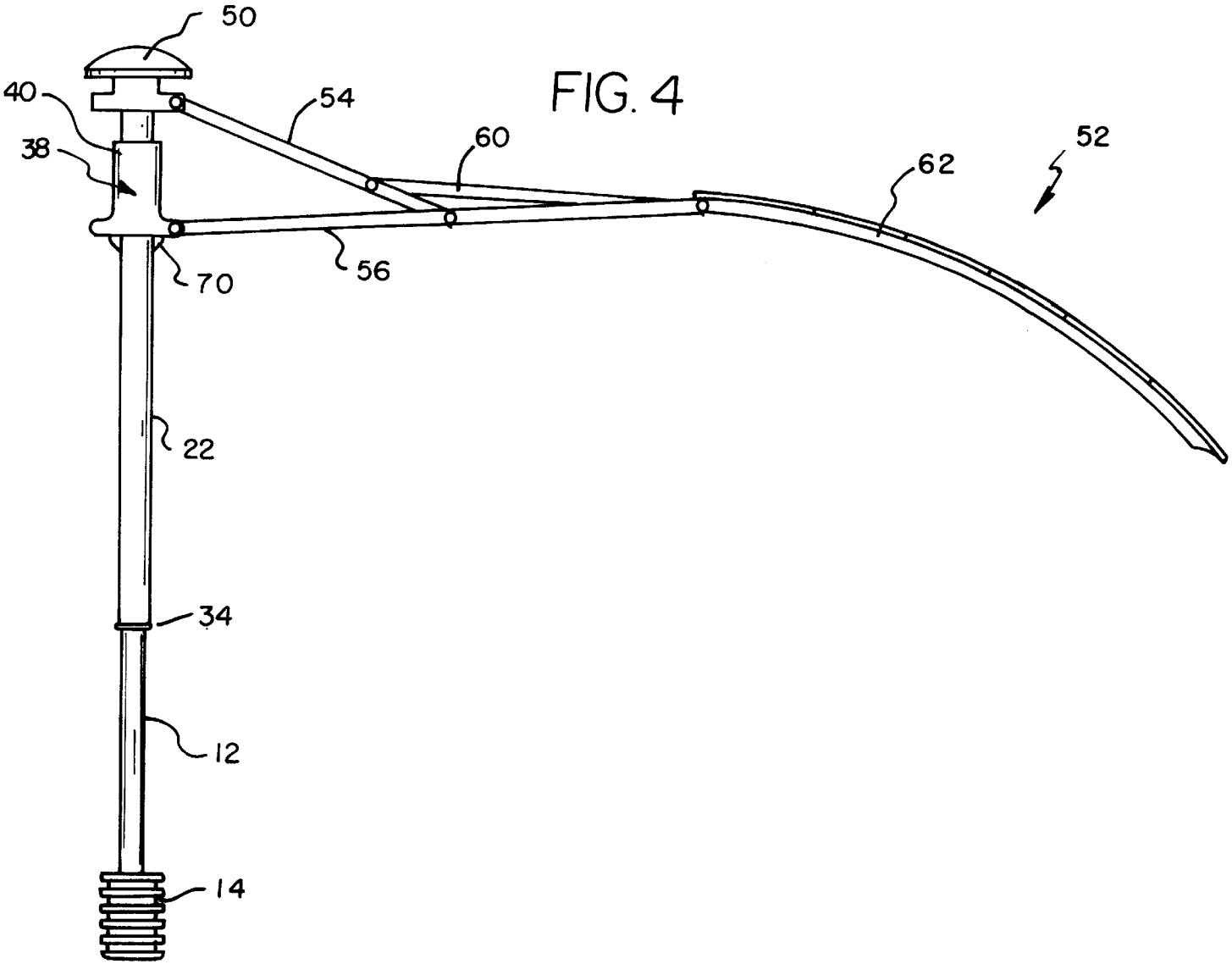
FIG. 4 is a side view of the present invention.

In use, upon the depression of the button of the air generator, pressure forces the piston and the cylinder of the slider assembly to the raised orientation. Ideally, the air pressure generated and the seal within the tubes is sufficient enough to raise the plunger into the upper tube. When raised, the cylinder of the slider assembly is locked in place via the spring biased plungers. Further, the aforementioned pressure forces the tubes to transfer to the extended orientation. The umbrella is thus ready for use as shown in FIG. 4.

Upon the sliding of the cylinder of the slider assembly to the raised orientation, a pressure builds between the cap and the piston. The purpose of this pressure is two-fold one of which is to damp the upward movement of the plunger and cylinder of the slider assembly. This pressure and the elastic material of the sheet further serve to force the cylinder of the slider assembly to the lowered orientation upon release of the cylinder of the slider assembly by the spring biased plungers. It should be noted that the slits of the tubes allow the pressure within the upper and lower tubes to equalize shortly after deployment of the canopy thereby ensuring that the pressurized air between the plunger and the cap and the elasticity of the sheet is capable of retracting the canopy assembly. When desired, the release of the plungers may be accomplished by positioning a button and battery adjacent the plungers or on the handle with a coiled wire or radio transceiver for communicating the aforementioned activation signal. It should be noted that retraction of the lower tube into the upper tube may be effected in several ways such as manual retraction, reversal of the air generator within the handle, or any other method. It should be noted that in other embodiments, the concepts of the present invention may be applied to satellite reflectors and the like. Other drive mechanisms such as hydraulic, motorized, or electromagnetic systems may be used to mechanize the present invention. Further options include a combination lock or the like and additional spring loaded plungers for keeping the upper and lower tubes extended.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An umbrella assembly comprising:

a lower tube with a hollow cylindrical configuration having a first diameter and a pair of diametrically opposed slits formed therein and extending along a length thereof with one side edge of each of the slits having a resilient lip extending therefrom for covering the associated slit and maintaining the lower tube air tight, the lower tube having a bottom end with a hollow cylindrical handle mounted thereon with a plurality of concentric undulations formed in an outer surface thereof the lower tube having a top end with an inwardly extending annular lip formed in an inner surface thereof;

an air pressure generator positioned within the handle for excreting air from the handle and into the lower tube upon the actuation thereof;

an upper tube with a hollow cylindrical configuration having an inner surface with a second diameter less than the first diameter and an outer surface with a third diameter greater than the first diameter, the upper tube having a pair of diametrically opposed slits formed therein with one of the side edges of each of the slits having a resilient lip extending therefrom for covering the associated slit of the upper tube and maintaining the upper tube air tight, the upper tube further having a concentric recess formed in between the inner surface and the outer surface of the upper tube, wherein the concentric recess extends between a central extent of the upper tube and a lower end of the upper tube, the lower end of the upper tube having an inwardly extending annular flange coupled to the inner surface of the upper tube, an outwardly extending annular flange mounted within the concentric recess, and an outwardly extending annular stop coupled to the outer surface of the upper tube, wherein the top end of the lower tube is slidably received within the concentric recess between a retracted orientation and an extended orientation with the outwardly extending annular flange of the upper tube in engagement with the inwardly extending annular lip of the lower tube, wherein the slits of the upper tube and the lower tube remain in alignment;

a slider assembly including a hollow cylinder slidably mounted along the outer surface of the upper tube, the cylinder of the slider assembly including a pair of radially spaced tangs extending outwardly therefrom at an upper edge thereof, a piston slidably positioned within the upper tube with a pair of diametrically opposed arms coupled thereto and extending therefrom through the slits of the tubes and coupled to an inner surface of the hollow cylinder for moving coincidentally therewith;

a cap mounted on an upper end of the upper tube;

a canopy assembly including a plurality of radially spaced upper inboard arms hingably coupled at inboard ends thereof to the cap and extending outwardly therefrom, a plurality of lower inboard arms with lengths greater than that of the upper inboard arms and pivotally coupled at inboard ends thereof to the tangs of the cylinder of the cylinder of the slider assembly and at a central extent thereof to outboard ends of the upper inboard arms, a plurality of intermediate arms having inboard ends pivotally coupled to the upper inboard arms, and a plurality of outboard arms each pivotally coupled to outboard ends of the intermediate arms and the lower inboard arms, the outboard arms each constructed from a resilient material and having an outer surface with an arcuate lateral cross-section, an inner surface with an arcuate lateral cross-section and a pair of side edges which are corrugated with a plurality of rectangular cut outs, the canopy assembly further including flexible elastic sheet mounted on the arms for defining a hemispherical configuration when the cylinder of the slider assembly is in a raised orientation and wherein the side edges of the outboard arms interlock to define a cylindrical shell which encompasses the tubes in concentric relationship upon the cylinder of the slider assembly being in a lowered orientation;

a pair of diametrically opposed spring biased plungers mounted within the upper tube between the inner surface and the outer surface thereof and extending outwardly therefrom;

wherein upon actuation of the air generator, pressure forces the piston and the cylinder of the slider assembly to the raised orientation whereat the same are locked in place by the spring biased plungers and the tubes are transferred to the extended orientation;

wherein upon the sliding of the cylinder of the slider assembly to the raised orientation, a pressure builds between the cap and the piston, said pressure and the elastic material adapted to force the cylinder of the slider assembly to the lowered orientation upon release of the cylinder of the slider assembly by the spring biased plungers.

2. An assembly comprising:

a tube;

a slider assembly including a slider slidably mounted along the tube; and a piston slidable within the tube which is fluid-filled and fluid-tight, the piston being connected to the slider of the slider assembly by an arm extending through a slot formed in the tube with a fluid-tight seal for sliding the slider of the slider assembly along the tube by way of pressurized fluid.

3. An assembly as set forth in claim 2 wherein the slider of the slider assembly is maintained in at least one orientation by way of a catch positioned on the tube.

4. An assembly as set forth in claim 2 wherein a retractable assembly is mounted on the tube and connected to the slider of the slider assembly thereby having a raised orientation when the slider and the piston are in a first orientation along the tube and a lowered orientation when the slider and the piston are in a second orientation along the tube.

5. An assembly as set forth in claim 4 wherein the pressurized fluid is generated by a pressure generator within a handle on the tube.

6. An assembly as set forth in claim 4 wherein the tube is defined by an upper tube and a lower tube slidably coupled with respect to each other.

7. A dome shaped assembly comprising:

a tube;

a slider assembly including a slider slidably mounted along the tube; and a retractable assembly mounted on the tube and connected to the slider of the slider assembly and having a raised orientation for deploying the retractable assembly and a lowered orientation for retracting the retractable assembly;

wherein the retractable assembly includes a plurality of arms at least a portion of which includes widened members which abut to form a shell encompassing the tube upon the slider of the slider assembly being transferred to the lowered orientation;

wherein said arms have interlocking side edges that interlock in the lowered orientation.

8. A dome shaped assembly as set forth in claim 7 wherein the widened arms include an arcuate cross-section for defining a cylindrical shell.

9. A dome shaped assembly as set forth in claim 7 wherein the arms each have corrugated side edges.

10. A dome shaped assembly as set forth in claim 7 wherein the tube is defined by an upper tube and a lower tube slidably coupled with respect to each other.

* * * * *

UNITED STATES PATENT AND TRADEMARK OFFICE

CERTIFICATE OF CORRECTION

PATENT NO. : 6,371,140 B2 
DATED : May 4, 2004
INVENTOR(S) : Robert P. Masleid, Akihiko Harada and Christophe Giacomotto It is certified that error appears in the above-identified patent and that said Letters Patent is hereby corrected as shown below:

Column 22,
Line 66, delete "front" and replace with -- from --

Signed and Sealed this

Thirtieth Day of November, 2004

JON W. DUDAS
*Director of the United States Patent and Trademark Office*

UNITED STATES PATENT AND TRADEMARK OFFICE

CERTIFICATE OF CORRECTION

PATENT NO. : 6,371,140 B1
DATED : April 16, 2002
INVENTOR(S) : Dele Atanda

It is certified that error appears in the above-identified patent and that said Letters Patent is hereby corrected as shown below:

This certificate supersedes Certificate of Correction issued November 30, 2004, the number was erroneously mentioned and should be vacated since no Certificate of Correction was granted.

Signed and Sealed this

Twenty-second Day of March, 2005

JON W. DUDAS
*Director of the United States Patent and Trademark Office*